US010854971B1

(12) United States Patent
Kaddour et al.

(10) Patent No.: US 10,854,971 B1
(45) Date of Patent: Dec. 1, 2020

(54) RECONFIGURABLE ARRAYS WITH FOLDABLE PANELS

(71) Applicants: Abdul-Sattar Kaddour, Miami, FL (US); Stavros Georgakopoulos, Miami, FL (US); Constantinos L. Zekios, Miami, FL (US)

(72) Inventors: Abdul-Sattar Kaddour, Miami, FL (US); Stavros Georgakopoulos, Miami, FL (US); Constantinos L. Zekios, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 0 days.

(21) Appl. No.: 16/857,449

(22) Filed: Apr. 24, 2020

(51) Int. Cl.

| | |
|---|---|
| ***H01Q 3/46*** | (2006.01) |
| ***H01Q 19/10*** | (2006.01) |
| ***H01Q 21/06*** | (2006.01) |
| ***H01Q 15/14*** | (2006.01) |
| *H01Q 1/28* | (2006.01) |

(52) U.S. Cl.
CPC ..... *H01Q 3/46* (2013.01); *H01Q 15/148* (2013.01); *H01Q 19/104* (2013.01); *H01Q 21/065* (2013.01); *H01Q 1/288* (2013.01)

(58) Field of Classification Search
CPC ..... H01Q 3/46; H01Q 15/148; H01Q 19/10; H01Q 19/104; H01Q 21/06; H01Q 21/065
See application file for complete search history.

(56) References Cited

U.S. PATENT DOCUMENTS

| | | | | |
|---|---|---|---|---|
| 8,289,221 | B1 * | 10/2012 | Finucane | H01Q 21/065 343/781 R |
| 2008/0143636 | A1 * | 6/2008 | Couchman | H01Q 1/422 343/915 |
| 2012/0235874 | A1 * | 9/2012 | Kwak | H01Q 1/288 343/837 |

OTHER PUBLICATIONS

Bryce Parker De Figueiredo, Developing New Classes of Thick-Origami-Based Mechanisms: Conceal-and-Reveal Motion and Folding Printed Circuit Boards, A thesis submitted to the faculty of Brigham Young University, Department of Mechanical Engineering, Nov. 1, 2017.

Richard E. Hodges et al., A Deployable High-Gain Antenna Bound for Mars, Developing a new folded-panel reflectarray for the first CubeSat mission to Mars, IEEE Antennas & Propagation Magazine, Apr. 2017, pp. 39-49.

* cited by examiner

*Primary Examiner* — Hoang V Nguyen
(74) *Attorney, Agent, or Firm* — Saliwanchik, Lloyd & Eisenschenk

(57) ABSTRACT

Arrays that are deployable and can change their electromagnetic behavior by changing their shape are provided. An array can include a central panel and at least one foldable panel attached thereto. The central panel can include radiating elements on its upper surface while each foldable panel can have radiating elements on its bottom surface. The array is reconfigurable by each foldable panel being foldable onto the central panel such that its bottom surface then faces upward and covers part or all of the upper surface of the central panel.

20 Claims, 11 Drawing Sheets

(a)

(b)

(c)

(d)

(c)

(b)

(a)

RECONFIGURABLE ARRAYS WITH FOLDABLE PANELS

GOVERNMENT SUPPORT

This invention was made with government support under Award Number FA9550-18-1-0191 awarded by the Air Force. The government has certain rights in the invention.

BACKGROUND

Cubesat missions for low-earth orbit have seen significant growth over the last decade offering new opportunities to expand space exploration. Two of their main advantages are their short design time and low fabrication cost. Space communication systems require High Gain Antennas (HGAs), such as Reflectarray Antennas (RAs), and parabolic reflectors. Foldable panel RAs are the most commonly used concept for CubeSat HGAs; they offer small stowed volume, low mass, and low cost. However, these RAs radiate in only one pre-defined direction while many applications require communications in multiple directions.

Implementing beamsteering techniques in Cubesat RAs is quite challenging because it introduces losses, increases cost, and requires high power. In addition, previously proposed foldable panels have not been reconfigurable and they are usually attached to one another using spring-loaded hinges, which require longer assembly times and a larger number of components, thereby increasing the production cost of RAs

BRIEF SUMMARY

Embodiments of the subject invention provide novel and advantageous arrays that are deployable and can change their electromagnetic behavior by changing their shape. An array can include a central panel and at least one foldable panel attached thereto. The central panel can include at least one radiating element on its upper surface while each foldable panel can have at least one radiating element on its bottom surface. The array is reconfigurable where each foldable panel can be folded onto the central panel such that its bottom surface then faces upward and covers (and thereby "replaces" for the purposes of radiating) part or all of the upper surface of the central panel. By including more foldable panels attached to the central panel, more configurations can be achieved where different foldable panels and/or different combinations of foldable panels can be folded onto the central panel to give different combinations of radiating elements facing upward. The foldable panels can be attached to the central panel via any suitable means, including for example hinges or creases in the substrate.

Any suitable actuation system can be used to fold and unfold the foldable panels, and the foldable panels and the central panel can each have any suitable shape (e.g., rectangular, triangular, square).

In an embodiment, an array can comprise: a central panel comprising an upper surface, a bottom surface opposite from the upper surface, and a first plurality of radiating elements disposed on the upper surface; and at least one foldable panel foldably attached to the central panel and comprising an upper surface, a bottom surface opposite from the upper surface, and a respective plurality of radiating elements disposed on the bottom surface. Each foldable panel can be foldable such that it is capable of: folding onto the upper surface of the central panel and having the bottom surface thereof face the upper surface of the central panel; and folding onto the bottom surface of the central panel and having the upper surface thereof face the bottom surface of the central panel. The array can be a reflectarray or a phased array. In the case of a reflectarray, the upper surface and/or the bottom surface of the central panel can be a full ground plane. The array can further comprising a plurality of hinges, and each foldable panel can be respectively attached to the central panel by a hinge of the plurality of hinges. The at least one foldable panel, the central panel, and the plurality of hinges can be monolithically formed with each other. A material of the substrate of the central panel can be the same as that of the respective substrate of each foldable panel. The respective pluralities of radiating elements of the at least one foldable panel can be configured such that different patterns of radiating elements are formed by folding different combinations of foldable panels onto the upper surface of the central panel.

In another embodiment, a method for changing the electromagnetic properties (including but not limited to the frequency of operation, the polarization, and the beam direction) of an array can comprise: providing an array as described herein; and folding at least one foldable panel onto the upper surface of the central panel such that the bottom surface of the at least one first foldable panel faces the upper surface of the central panel, thereby having the plurality of radiating elements of the at least one foldable panel be visible from a point of view above the upper surface of the central panel and changing the electromagnetic properties of the array. The electromagnetic properties can include but are not limited to the frequency of operation, the polarization, and the beam direction). In a further embodiment where the array has four foldable panels, the method can comprise: folding first and second foldable panels onto the upper surface of the central panel and having the bottom surfaces thereof face the upper surface of the central panel, thereby having the pluralities of radiating elements thereof be visible from the point of view above the upper surface of the central panel; folding a third foldable panel onto the bottom surface of the central panel and having the upper surface thereof face the bottom surface of the central panel; and folding a fourth foldable panel onto the bottom surface of the central panel and having the upper surface thereof face the bottom surface of the central panel. Such a method can further comprise: folding the first and second foldable panels onto the bottom surface of the central panel and having the respective upper surfaces of the first and second foldable panels face the bottom surface of the central panel; and folding the third and fourth foldable panels onto the upper surface of the central panel and having the respective bottom surfaces thereof face the upper surface of the central panel, thereby having the respective pluralities of radiating elements thereof be visible from the point of view above the upper surface of the central panel and changing the electromagnetic properties (e.g., the frequency of operation, the polarization, and/or the beam direction) of the array.

BRIEF DESCRIPTION OF DRAWINGS

FIG. 7(*b*) is a top view of an array according to an embodiment of the subject invention.

FIG. 7(*c*) is a bottom view of an array according to an embodiment of the subject invention.

FIG. 8(*b*) is a plot of reflection magnitude (in decibels (dB)) versus patch size (in mm) for an array according to an embodiment of the subject invention. The solid line is for normal incidence, and the dashed line is for θ=0°.

FIG. 10(*b*) is a top view of the fabricated array according to an embodiment of the subject invention when the two panels on the left and the right are folded forward.

FIG. 10(*c*) is a top view of the fabricated array according to an embodiment of the subject invention when the left panels and right panels are folded backward and forward, respectively.

FIG. 10(*d*) is a top view of the fabricated array according to an embodiment of the subject invention when the left panels and right panels are folded forward and backward, respectively.

FIG. 11(*b*) is a close-up view of the hinge of FIG. 11(*b*), in a folded state.

FIG. 12(*b*) is a plot of the simulated and measured realized gain (in decibels relative to an isotropic radiator (dBi)) versus θ (in degrees) of the fabricated array according to an embodiment of the subject invention when the two panels are folded forward.

FIG. 12(*c*) is a plot of the simulated and measured realized gain (in decibels relative to an isotropic radiator (dBi)) versus θ (in degrees) of the fabricated array according to an embodiment of the subject invention when the left panels and right panels are folded backward and forward, respectively.

FIG. 12(*d*) is a plot of the simulated and measured realized gain (in decibels relative to an isotropic radiator (dBi)) versus θ (in degrees) of the fabricated array according to an embodiment of the subject invention when the left panels and right panels are folded forward and backward, respectively.

DETAILED DESCRIPTION

Embodiments of the subject invention provide novel and advantageous arrays that are deployable and can change their electromagnetic behavior by changing their shape. An array can include a central panel and at least one foldable panel attached thereto. The foldable panels can be monolithically formed with the central panel, though embodiments are not limited thereto. The central panel can include at least one radiating element on its upper surface while each foldable panel can have at least one radiating element on its bottom surface. The array is reconfigurable where each foldable panel can be folded onto the central panel such that its bottom surface then faces upward and covers (and thereby "replaces" for the purposes of radiating) part or all of the upper surface of the central panel. By including more foldable panels attached to the central panel, more configurations can be achieved where different foldable panels and/or different combinations of foldable panels can be folded onto the central panel to give different combinations of radiating elements facing upward. The foldable panels can be attached to the central panel via any suitable means, including for example hinges or creases in the substrate. Any suitable actuation system can be used to fold and unfold the foldable panels, and the foldable panels and the central panel can each have any suitable shape (e.g., rectangular, triangular, square).

Arrays of embodiments of the subject invention can steer their beam or change their polarization or operation frequency by using different combinations of folds of the foldable panels. The arrays can achieve multiple operation states by reconfiguring their structure through folding of the foldable panels. The term "array" as used herein refers to phased arrays and reflectarrays. Any suitable substrate (rigid or flexible) can be used for the arrays, including but not limited to Duroid, FR4, or Kapton. Any conductive material can be used for the arrays, including but not limited to copper, aluminium, silver, gold, or platinum.

Figure 1:
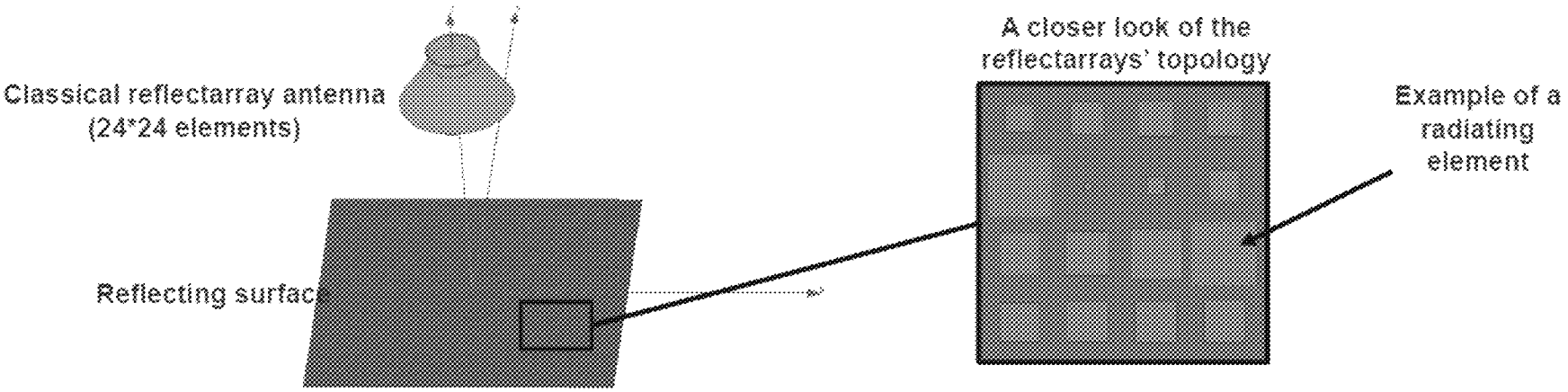
FIG. 1 is a schematic view showing an array and antenna.

A reflectarray is an antenna with a flat or slightly curved reflecting surface and an illuminating feed antenna. Many radiating elements are typically present on the reflecting surface. The feed antenna spatially illuminates the radiating elements that are designed to reradiate and scatter the incident field with electrical phases that are required to form a planar phase front in the far-field distance. Several methods can be used for reflectarray elements to achieve a planar phase front. FIG. 1 shows an example of using variable sized radiating element patches so that the radiating elements can have different scattering impedances and, thus, different phases to compensate for the different feed-path delays.

Figure 2:
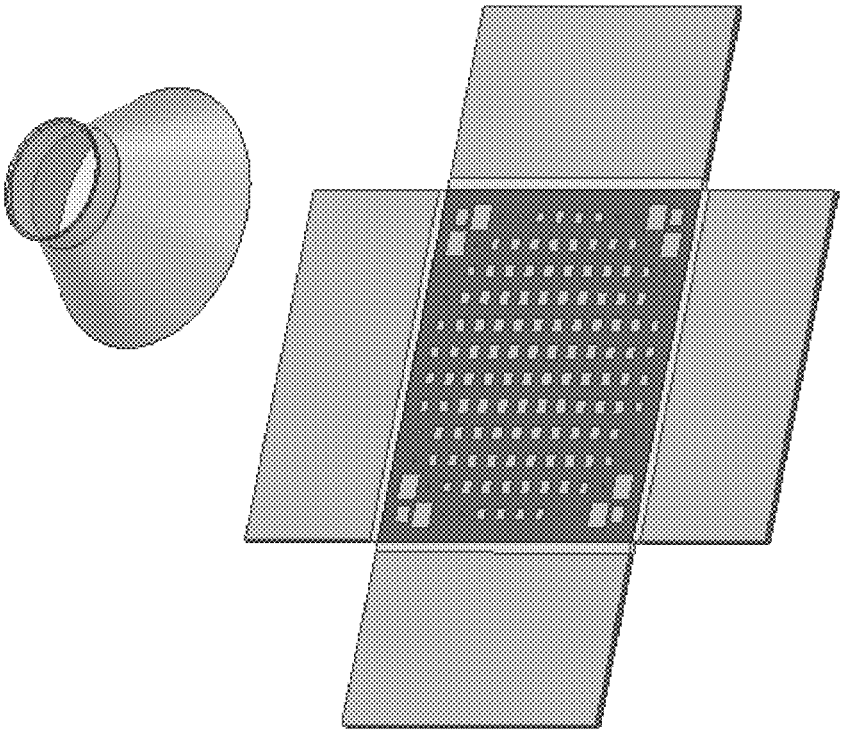
FIG. 2 is a schematic view showing an array according to an embodiment of the subject invention, depicted with a horn antenna.
Figure 3:
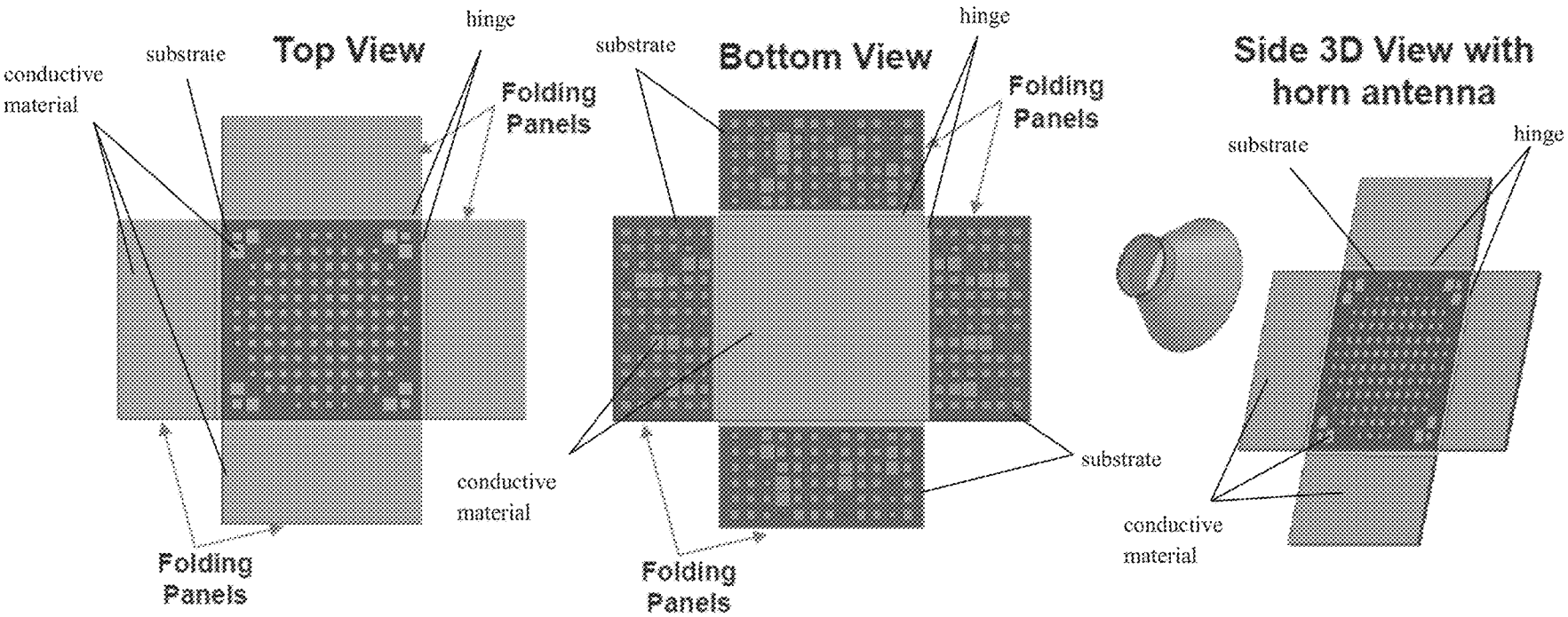
FIG. 3 shows a top view, bottom view, and schematic side view (with an antenna) of an array according to an embodiment of the subject invention.

FIG. 2 is a schematic view showing an array according to an embodiment of the subject invention, depicted with a horn antenna. In addition, FIG. 3 shows a top view, bottom view, and schematic side view (with an antenna) of an array according to an embodiment of the subject invention. Referring to FIGS. 2 and 3, the central panel (the one showing the radiating elements (of conductive material) on the upper surface in the top view) has radiating elements on its upper surface while the foldable panels have radiating elements on the bottom surfaces thereof. By folding one or more of the foldable panels, different patterns of radiating elements can be formed on the upper surface of the array. For example, the uppermost and lowermost (as depicted in FIG. 3) foldable panels can be folded to cover the central panel with the patterns on the bottom surfaces of these two panels (depicted as Case 3 in FIG. 4).

Referring still to FIGS. 2 and 3, a reconfigurable array can serve the function of multiple different arrays while being packed into the size of a single array to save space. The folding abilities can also be used to achieve electromagnetic reconfigurability (e.g., beamsteering, polarization reconfigurability, frequency reconfigurability). Such an array can achieve enhanced performance with low losses and low cost compared to the state-of-the-art existing reflectarrays. Although FIGS. 2 and 3 (and 4 and 6) depict hinges between the central panel and the foldable panels, this is for exemplary purposes only; the foldable panels can be attached to the central panel via any suitable means.

Figure 4:
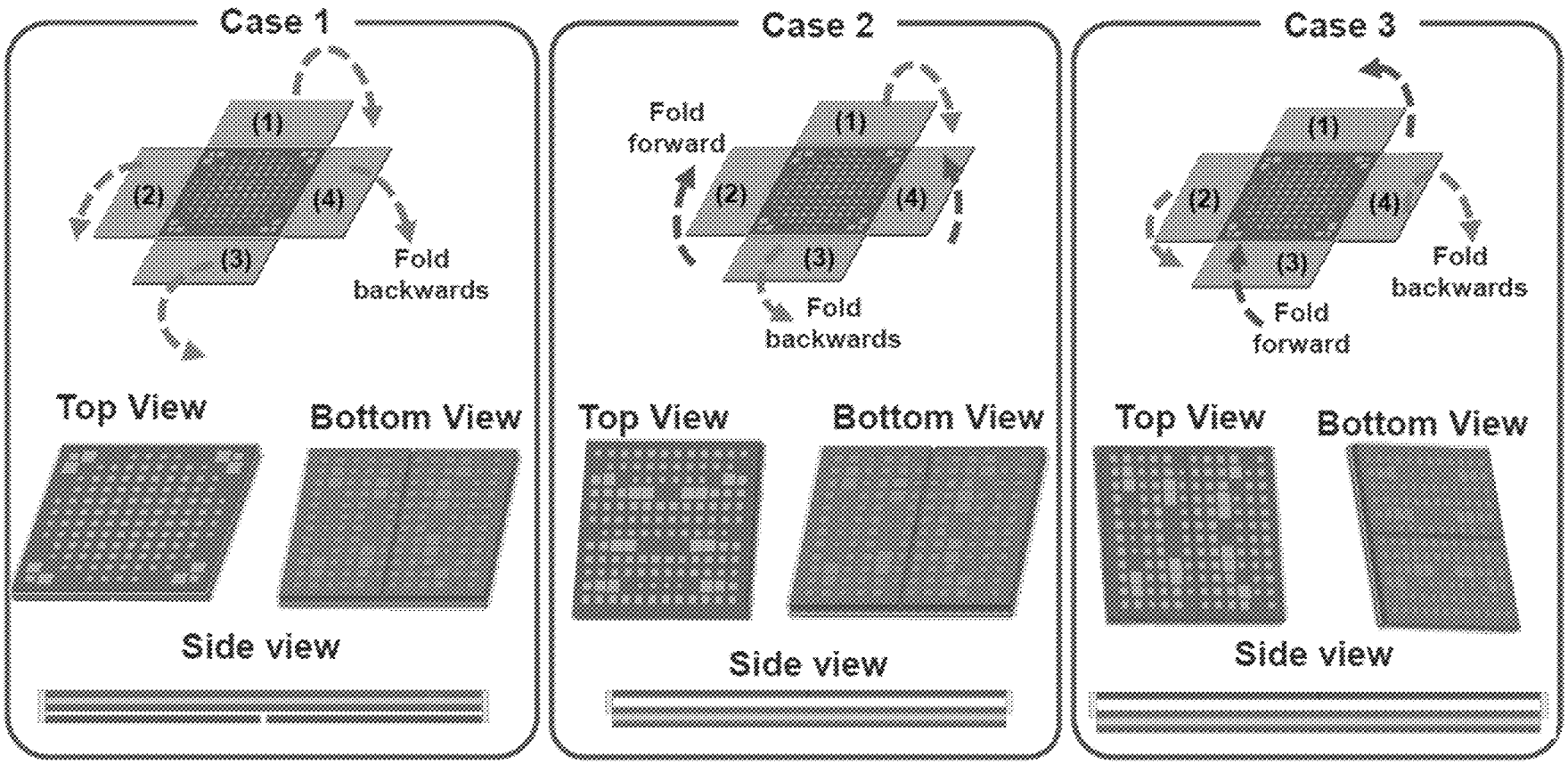
FIG. 4 shows schematic views of three different cases of folding panels of an array according to an embodiment of the subject invention.

FIG. 4 shows schematic views of three exemplary cases of folding panels of the array shown in FIG. 3. Referring to FIG. 4, in exemplary Case 1, all foldable panels are folded down such that their radiating elements are then up against the bottom surface of the central panel, leaving the radiating elements of the central panel fully exposed. In exemplary Case 2, foldable panels (1) and (3) are folded down while foldable panels (2) and (4) are folded up such that their radiating elements are facing up; the central panel is covered by foldable panels (2) and (4). In exemplary Case 3, foldable panels (2) and (4) are folded down while foldable panels (1) and (3) are folded up such that their radiating elements are facing up; the central panel is covered by foldable panels (1) and (3). Referring to the bottom portion of FIG. 4, the pattern of radiating elements on the top of the array is different for each case, meaning that the array can perform the function of three different arrays while only occupying the space or volume of one array.

Figure 5:
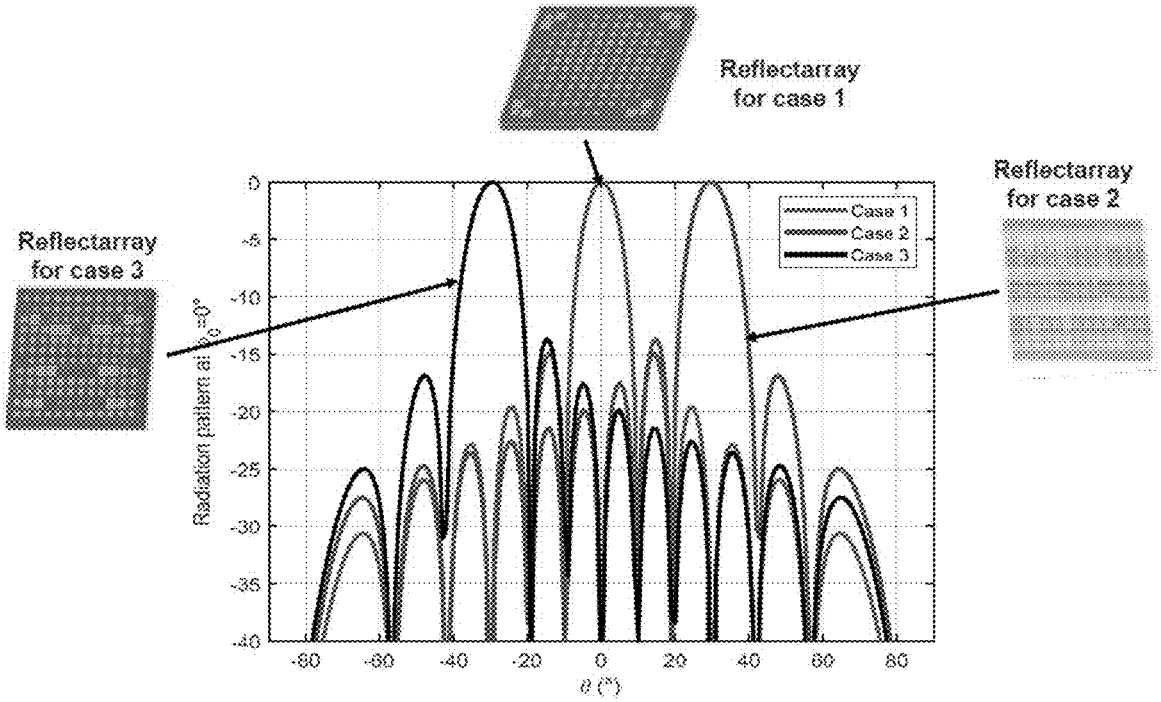
FIG. 5 is a plot of radiation pattern at $\phi_0=0°$ versus θ (in degrees), for the three cases depicted in FIG. 4.

In Case 1, the central panel steers its beam in the broadside direction ($\theta=0°$, $\varphi=0°$); in Case 2, the array steers the beam in the direction $\theta=-30°$, $\varphi=0°$; and in Case 3, the array steers the beam in the direction $\theta=30°$, $\varphi=0°$. FIG. 5 is a plot of elevation radiation pattern at $\phi_0=0°$ versus $\theta$ for the three cases depicted in FIG. 4. Referring to FIG. 5, the beam steering from −30° to 0° to 30° is confirmed.

Figure 6:
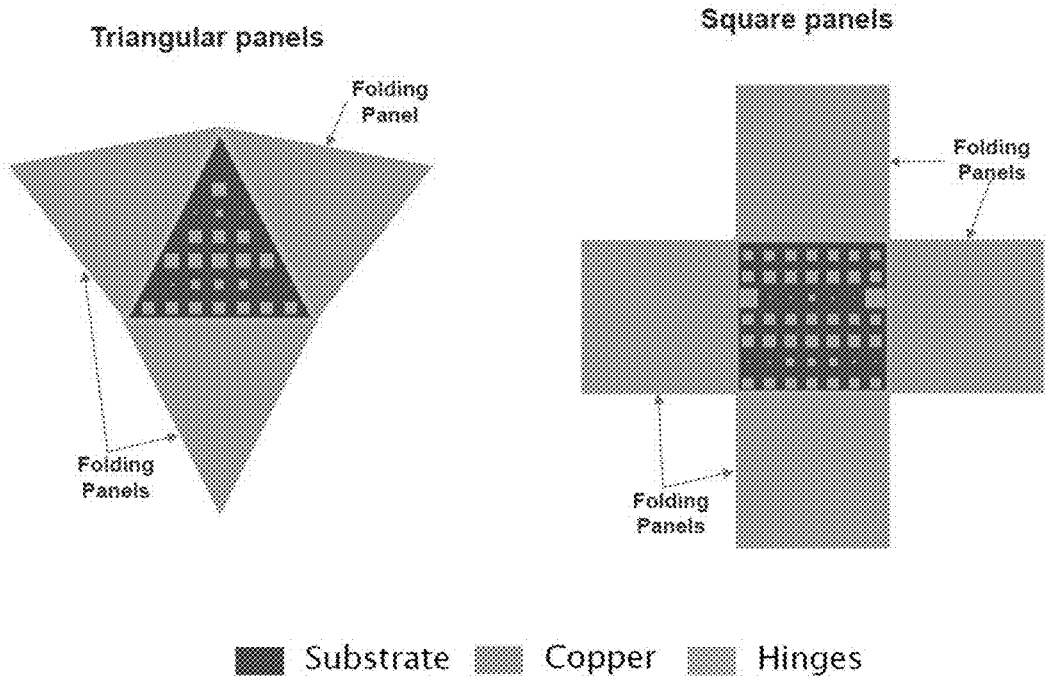
FIG. 6 shows examples of differently-shaped panels for arrays of embodiments of the subject invention.

The array shown in FIGS. 2-4 is for exemplary purposes only, and the concept can be extended to different shapes of foldable and/or central panels and different quantities of foldable panels. FIG. 6 shows an example of a triangular central panel and three triangular foldable panels, as well as an array with square panels as also shown in FIGS. 2-4. It is also possible to have foldable panels of sizes smaller than that of the central panel, such that when folded up part of the central panel upper surface is still exposed. There can also be any suitable number of foldable panels (e.g., 1, 2, 3, 4, 5, 6, 7, 8, 9, 10, 11, 12, 13, 14, 15, 16, 17, 18, 19, 20, or more), depending on the number of operating states desired. For each operation state only one reflectarray may be illuminated.

The foldable panels can be attached to the central panel via any suitable means, including for example hinges or creases in the substrate. For example, hinges can be used and can be made using the same substrate material as the central panel and the foldable panels. That is, the hinge(s) can be formed by making slots or other gaps in the material to make it bendable, such that the central panel, the hinge(s), and the foldable panel(s) are monolithically formed.

Embodiments of the subject invention can reconfigure their electromagnetic characteristics and can also be efficiently packed. The arrays can change their shape through folding, enabling them to reconfigure performance and provide multi-functionality, such that the user can direct the beam in the desired direction and not have to rely only on the electronic configuration that is conventionally used. The arrays can reconfigure their electromagnetic performance (e.g., beamsteering, polarization reconfigurability, frequency reconfigurability) by folding a combination of the foldable panels to change the electromagnetic design (layout). Use of such arrays provides new capabilities to communication systems (e.g., satellite communications systems). Embodiments of the subject invention can be used in several fields, including but not limited to multi-functional communications, satellite communication systems, and deployable, packable, and collapsible arrays.

A greater understanding of the embodiments of the subject invention and of their many advantages may be had from the following examples, given by way of illustration. The following examples are illustrative of some of the methods, applications, embodiments, and variants of the present invention. They are, of course, not to be considered as limiting the invention. Numerous changes and modifications can be made with respect to the invention.

Example 1

Figure 7A:
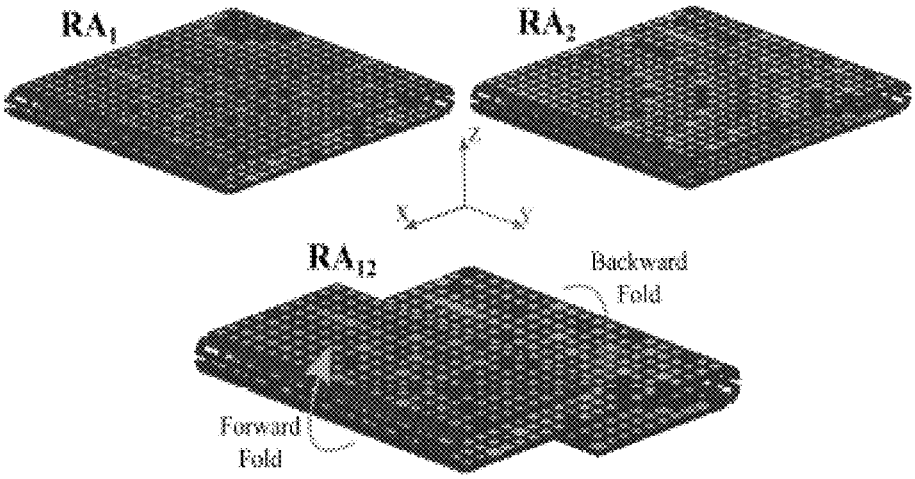
FIG. 7(*a*) shows a perspective view of an array according to an embodiment of the subject invention.
Figure 7B:
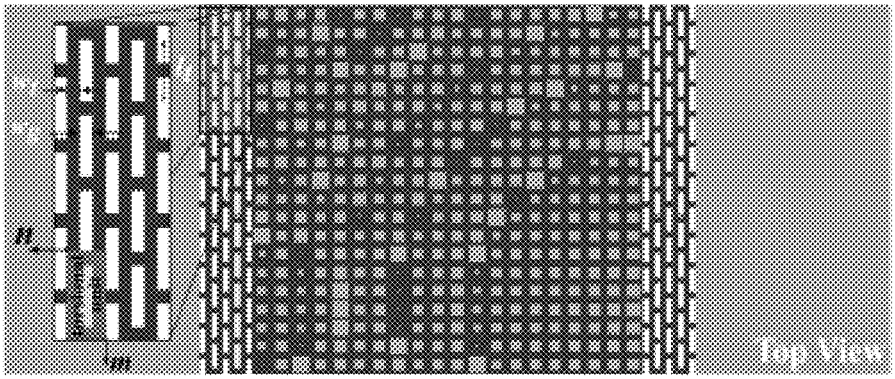
Figure 7C:
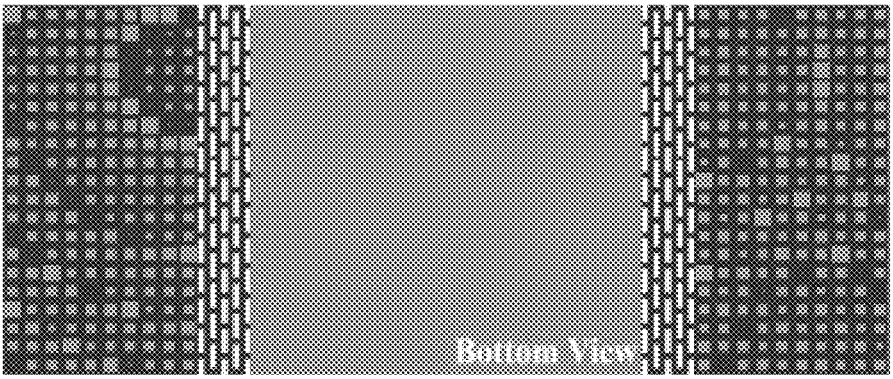

A reconfigurable monolithic reflectarray with foldable panels was designed and tested. The reflectarray had a central panel and two foldable panels (each approximately one half of the width of the central panel), such that at least three different configurations can be used, as shown in FIG. 7(*a*) and labeled as $RA_1$ (with both panels folded up), $RA_2$ (with both panels folded down), and $RA_{12}$ (with one panel folded up and one panel folded down). The foldable panels and the hinges can all be manufactured in a single process to give a monolithic array. The array has beam-steering capabilities, and multiple reflectarray apertures can be optimized to radiate toward specific directions and can be arranged so that when the panels are folded forward or backward a new reflectarray aperture is illuminated. $RA_1$ and $RA_2$ can each provide a single pencil beam, and $RA_{12}$ can provide dual beam radiation. The principle of the dual-beam radiation pattern is based on dividing the reflectarray surface into two sub-arrays, where each sub-array can radiate a beam toward a desired direction.

Figures 8A, 8B:
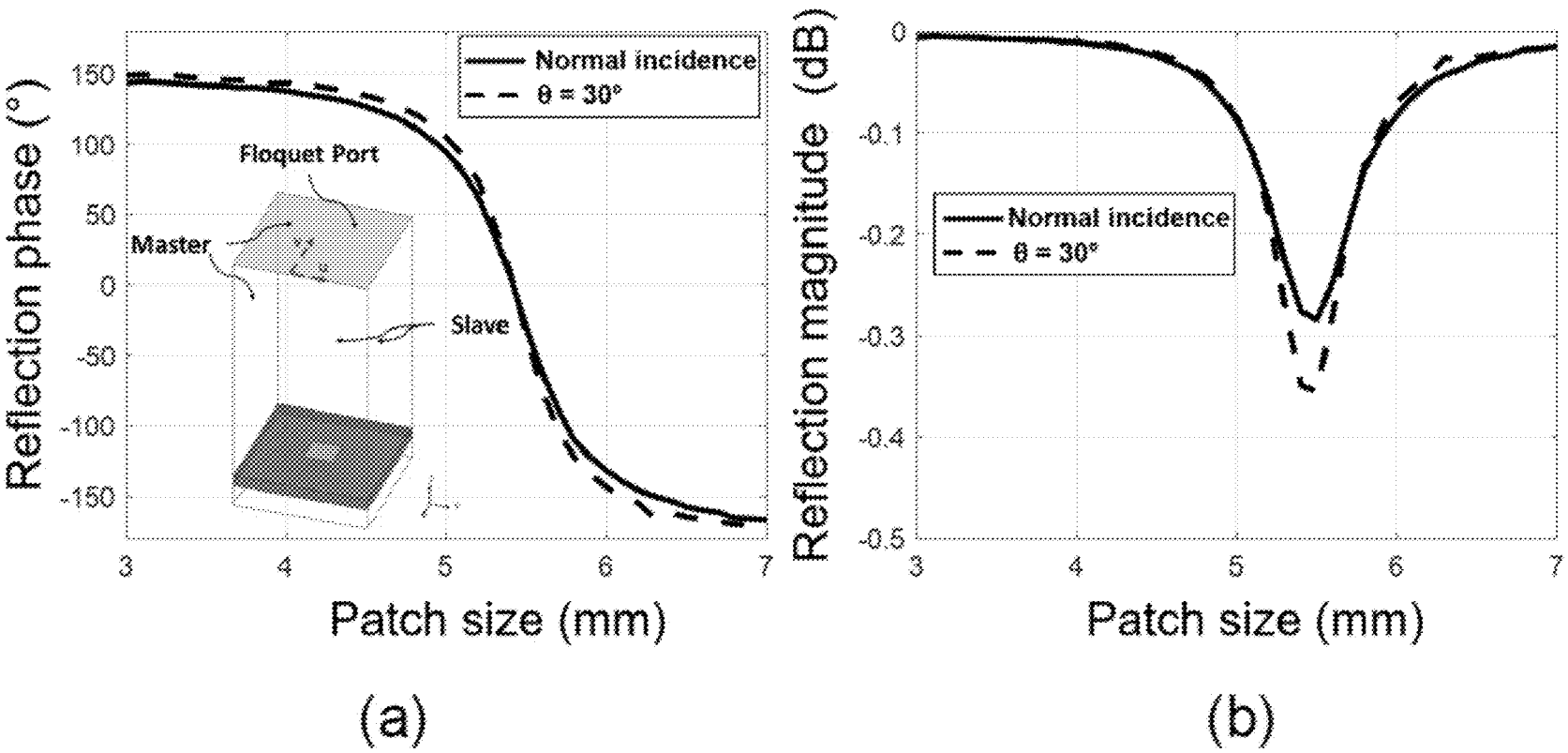
FIG. 8(*a*) is a plot of reflection phase (in degrees) versus patch size (in millimeters (mm)) for an array according to an embodiment of the subject invention. The solid line is for normal incidence, and the dashed line is for θ=0°.

The properties of the reflectarray were determined using a simulation with ANSYS HFSS with master-slave boundaries. FIG. 8(*a*) is a plot of the reflection phase (in degrees) versus patch size (in mm) for the reflectarray, and FIG. 8(*b*) is a plot of the reflection magnitude (in decibels (dB)) versus patch size (in mm). In both FIGS. 8(*a*) and 8(*b*), the solid line is for normal incidence, and the dashed line is for $\theta=0°$. Referring to FIGS. 8(*a*) and 8(*b*), the reflectarray was designed to operate in the Ku-band with a center frequency of 16 GHz, with an element spacing of 18.75 mm (0.5λ). It included a square patch on the top of a Rogers 5870 ($\varepsilon_r=2.33$, $\tan\delta=0.0013$, thickness=30 mils (0.030 inches)) substrate. The phase and amplitude responses of the unit cell for various patch sizes were simulated for normal incidence as well as for incident angle of $\theta=30°$ at 16 GHz. A reflection phase response with 310° range can be achieved with a maximum loss of 0.35 dB.

Two surrogate hinges were introduced in the design to make the reflectarray foldable, as seen in FIGS. 7(*b*) and 7(*c*). The surrogate hinges were realized by making slots in a single piece of thick, rigid material (e.g., a printed circuit board (PCB)). The slots allowed the rigid structure to fold/unfold around the axis of the hinge by providing enough room for the slight deformation required while the structure is bent. The hinges were appropriately designed to bend ±180° while maintaining mechanical integrity between the two sides. The dimensions of the hinge segments were a length ($l_t$) of 14.8 mm, a width ($w_t$) of 0.8 mm, and a gap width ($w_g$) of 0.8 mm (see FIG. 7(*b*)) were appropriately optimized to ensure the robustness and mechanical stability of the array while folding.

For design simplification, two foldable panels were used. A linearly polarized horn is placed at 8.7λ from the center of the reflectarray with an offset of 20° in the yz plane. The required phase shift of the elements on each aperture was calculated using the ray-tracing method. Two pencil beams focused in (θ=30°, φ=0°) and (θ=−30°, φ=0°) were designed for $RA_1$ and $RA_2$, respectively. Two combinations were possible for the dual-beam operation, one being the right panel of $RA_2$ folded up and the left panel down, or the opposite.

Figure 9:
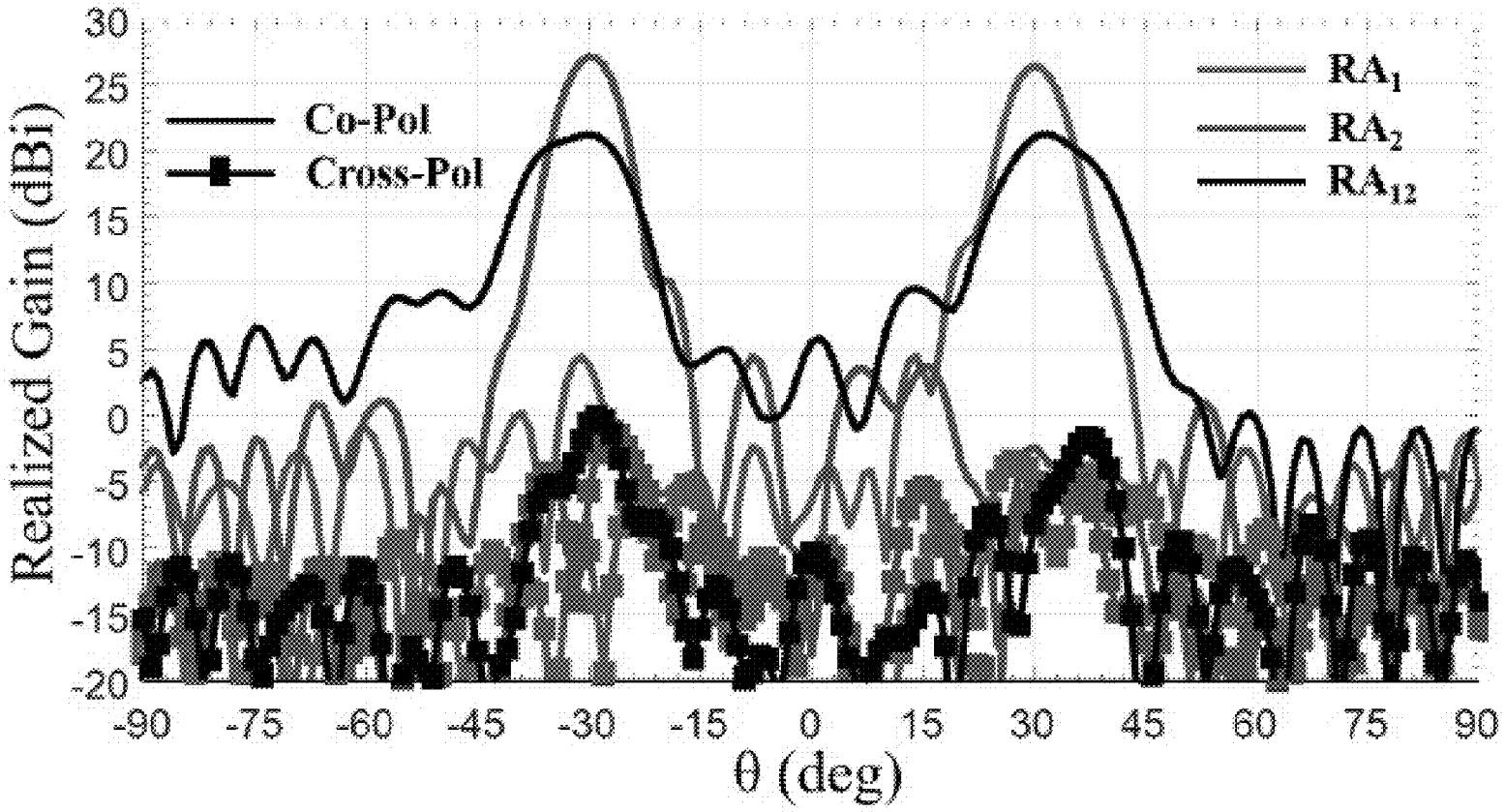
FIG. 9 is a plot of realized gain (in decibels relative to an isotropic radiator (dBi)) versus θ (in degrees).
Figure 10A:
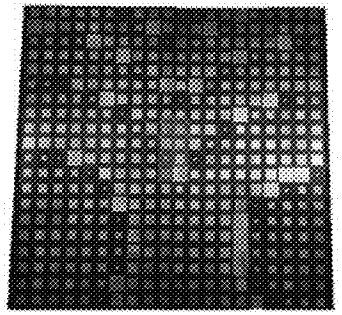
FIG. 10(*a*) is a top view of the fabricated array according to an embodiment of the subject invention.
Figure 10B:
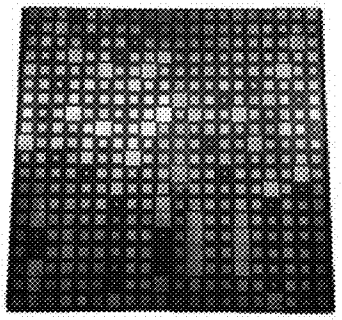
Figure 10C:
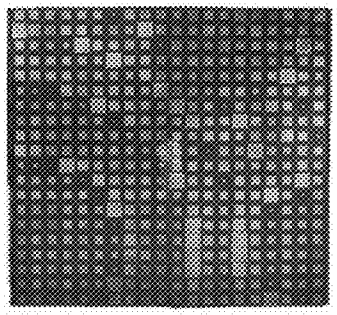
Figure 10D:
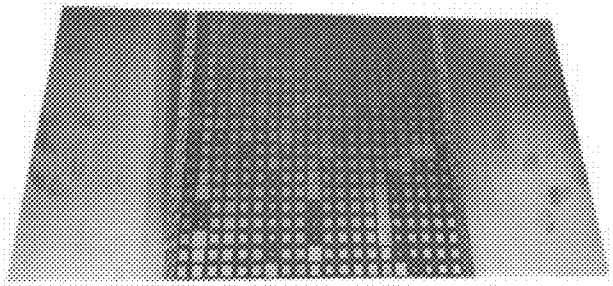

FIG. 9 is a plot of realized gain (in decibels relative to an isotropic radiator (dBi)) versus θ (in degrees). FIG. 9 shows the radiation patterns for different combinations, computed using Ansys HFSS. It can be seen that $RA_1$ and $RA_2$ provide single pencil beams at 30° and −30° respectively, with −20 dB side-lobe level (SLL), while $RA_{12}$ provides a dual-beam pattern with peaks at ±30° and −9 dB SLL. The beam broadening and the side-lobe levels of $RA_{12}$ can be improved by increasing the number of elements (size) of the sub-array.

Figure 11B:
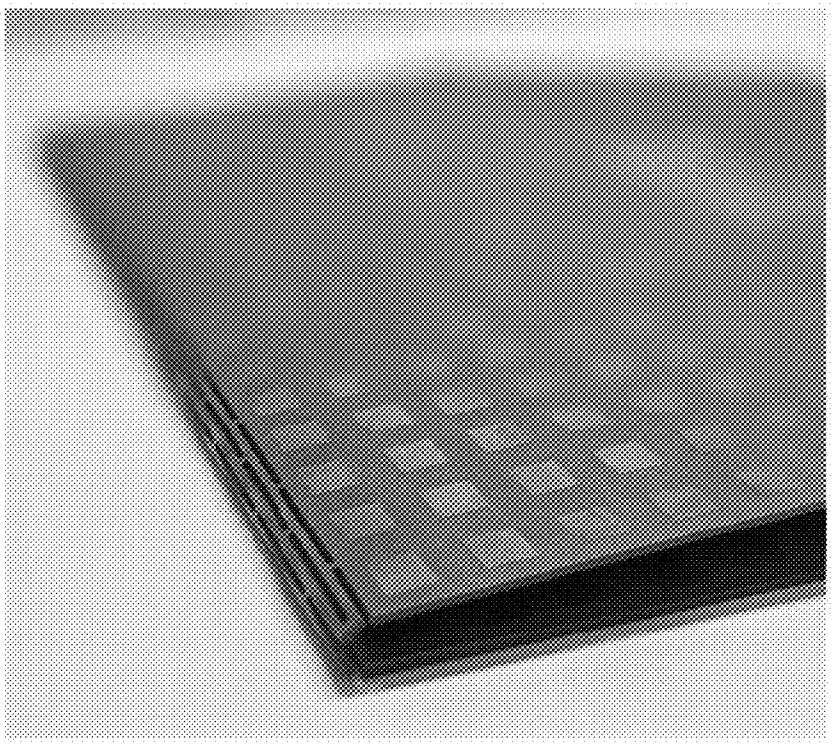
FIG. 11(*a*) is a close-up view of a fabricated surrogate hinge, in a flat state, according to an embodiment of the subject invention.
Figure 11A:
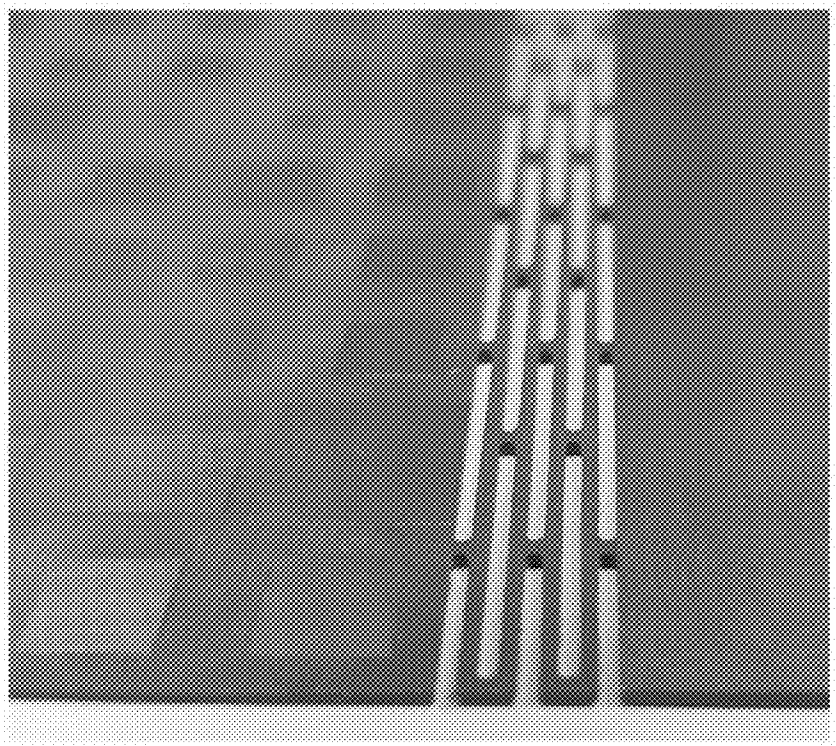

A prototype of the reflectarray example was manufactured in a single step using standard PCB fabrication. The different folding states of the reflectarray, namely, $RA_1$, $RA_2$, $RA_{12}$, and $RA_{21}$ are depicted in FIG. 10. In its unfolded state, $RA_1$ is shown in FIG. 10(*a*). FIG. 10(*b*) shows the reflectarray when both of its panels are folded forward, and this aperture was named $RA_2$. Also, apertures $RA_{12}$ and $RA_{21}$ are shown in FIGS. 10(*c*) and 10(*d*), respectively. FIGS. 11(*a*) and 11(*b*) show magnified views of the surrogate hinge in its flat and folded states, respectively.

Figures 12A, 12B, 12C, 12D:
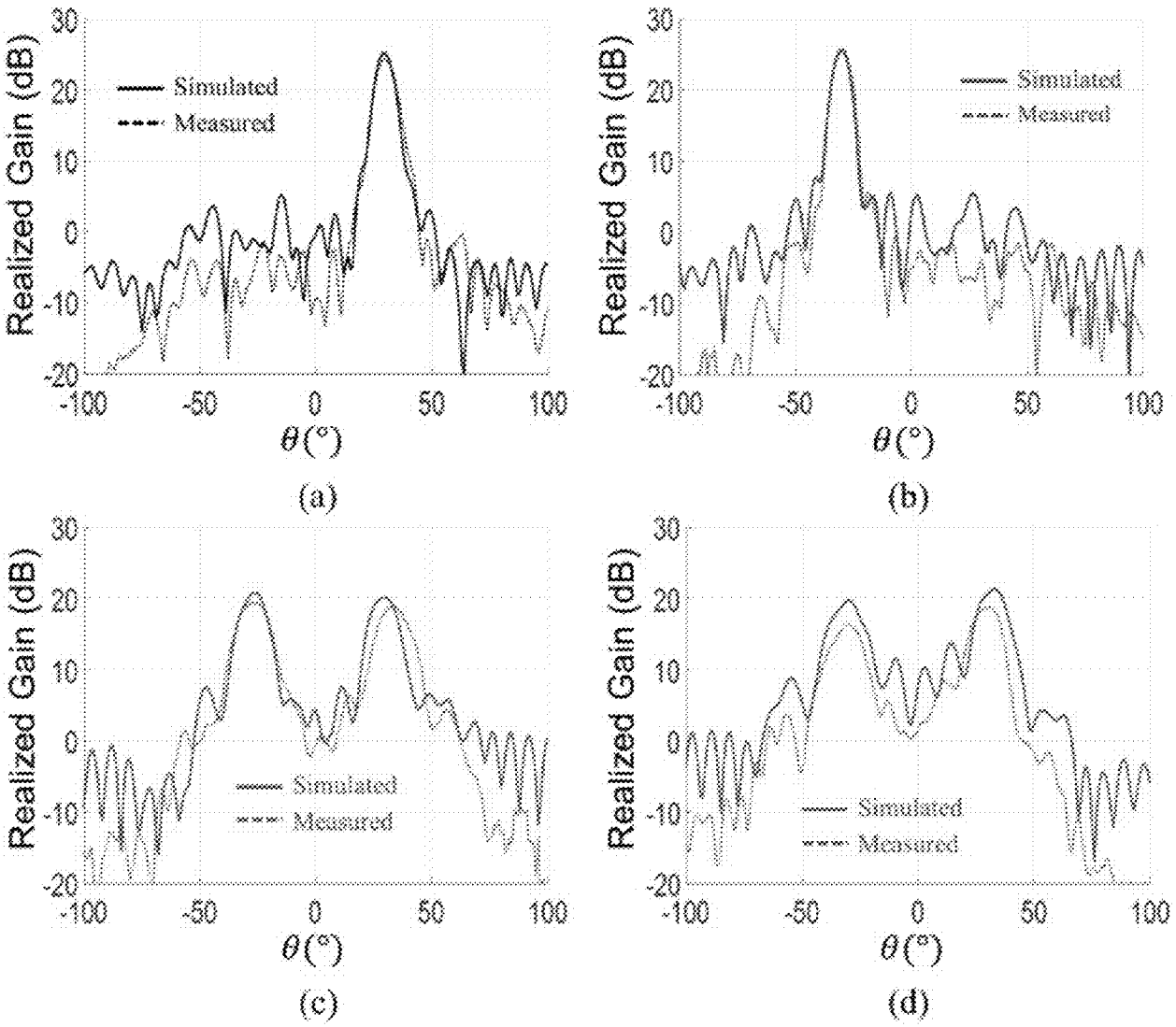
FIG. 12(*a*) is a plot of the simulated and measured realized gain (in decibels relative to an isotropic radiator (dBi)) versus θ (in degrees) of the fabricated array according to an embodiment of the subject invention when the two panels are folded backward.

The performance of the fabricated RA was measured using an MVG Starlab system. FIG. 12 compares the simulations and measurements of the realized gain pattern, which agree very well, for all the different folding states of the RA. $RA_1$ and $RA_2$ exhibited a maximum measured gain of 24 dB at (θ=30°, φ=0°) and 25 dB at (θ=−30°, φ=0°), respectively. Also, $RA_1$ and $RA_2$ had side-lobe levels below −15 dB. The difference in gain between $RA_1$ and $RA_2$ is attributed to the slightly better spillover efficiency of $RA_2$. This is attributed to the fact that the aperture of $RA_2$ is closer to the feed (because the panels are folded forward) than the aperture of $RA_1$. The aperture is closer to the feed when the $RA_2$ panels are folded forward. The realized gain patterns of the dual-beam configuration $RA_{12}$ and $RA_{21}$ are shown in FIGS. 12(*c*) and 12(*d*), respectively. $RA_{12}$ exhibited a gain of 19 dB and 18 dB at θ=30° and θ=−30°, respectively. $RA_{21}$ exhibited a gain of 18 dB and 16 dB at θ=30° and θ=−30°, respectively. The difference in gain between the two beams is associated with interference of $RA_1$ beneath the folded panel of either $RA_{12}$ or $RA_{21}$. This loss in gain was not observed with $RA_2$ due to both panels being folded forward and closely aligned, thereby completely blocking aperture $RA_1$ from illumination. In fact, the interference of $RA_1$ in the performance of $RA_{12}$ and $RA_{21}$ causes a progressive phase error as the required phase at the inner edge of the aperture is not ideal for the second beam.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. An array, comprising:

a central panel comprising an upper surface, a bottom surface opposite from the upper surface, and a first plurality of radiating elements disposed on the upper surface; and a first foldable panel foldably attached to the central panel and comprising an upper surface, a bottom surface opposite from the upper surface, and a second plurality of radiating elements disposed on the bottom surface, the first foldable panel being foldable such that it is capable of: folding onto the upper surface of the central panel and having the upper surface of the first foldable panel face the bottom surface of the central panel; and folding onto the bottom surface of the central panel and having the upper surface of the first foldable panel face the bottom surface of the central panel, and the array being a reflectarray or a phased array.

2. The array according to claim 1, comprising a plurality of foldable panels foldably attached to the central panel and each respectively comprising an upper surface, a bottom surface opposite from the upper surface, and a plurality of radiating elements disposed on the bottom surface, each foldable panel being foldable such that it is capable of: folding onto the upper surface of the central panel and having the upper surface thereof face the upper surface of the central panel; and folding onto the bottom surface of the central panel and having the bottom surface thereof face the bottom surface of the central panel, and the plurality of foldable panels comprising the first foldable panel.

3. The array according to claim 2, further comprising a plurality of hinges, each foldable panel being respectively attached to the central panel by a hinge of the plurality of hinges.

4. The array according to claim 3, the plurality of foldable panels, the central panel, and the plurality of hinges being monolithically formed with each other.

5. The array according to claim 2, the upper surface of each foldable panel having an area that is about one half that of the upper surface of the central panel.

6. The array according to claim 2, the upper surface of each foldable panel having an area that is less than that of the upper surface of the central panel.

7. The array according to claim 2, the central panel comprising a substrate on which the first plurality of radiating elements disposed on the upper surface, each foldable panel comprising a respective substrate on which the respective plurality of radiating elements is disposed, and a material of the substrate of the central panel being the same as that of the respective substrate of each foldable panel.

8. The array according to claim 2, the respective pluralities of radiating elements of the plurality of foldable panels being configured such that different patterns of radiating elements are formed by folding different combinations of foldable panels of the plurality of foldable panels onto the upper surface of the central panel.

9. The array according to claim 1, further comprising a hinge attaching the first foldable to the central panel, and the first foldable panel, the central panel, and the hinge being monolithically formed with each other.

10. The array according to claim 1, the upper surface of the first foldable panel having an area that is less than that of the upper surface of the central panel.

11. The array according to claim 1, the central panel comprising a substrate on which the first plurality of radiating elements disposed on the upper surface, the first foldable panel comprising a substrate on which the second plurality of radiating elements is disposed, and a material of the substrate of the central panel being the same as that of the substrate of the first foldable panel.

12. A method for changing the electromagnetic properties of an array, the array comprising:

a central panel comprising an upper surface, a bottom surface opposite from the upper surface, and a first plurality of radiating elements disposed on the upper surface; and a first foldable panel foldably attached to the central panel and comprising an upper surface, a bottom surface opposite from the upper surface, and a second plurality of radiating elements disposed on the bottom surface, the first foldable panel being foldable such that it is capable of: folding onto the upper surface of the central panel and having the upper surface of the first foldable panel face the upper surface of the central panel; and folding onto the bottom surface of the central panel and having the bottom surface of the first foldable panel face the bottom surface of the central panel, the array being a reflectarray or a phased array, and the method comprising:

folding the first foldable panel onto the upper surface of the central panel and having the upper surface of the first foldable panel face the upper surface of the central panel, thereby having the second plurality of radiating elements be visible from a point of view above the upper surface of the central panel and changing the electromagnetic properties of the array.

13. The method according to claim 12, the electromagnetic properties of the array that are changed when the first foldable panel is folded onto the upper surface of the central panel comprising at least one of frequency of operation, polarization, and beam direction.

14. The method according to claim 12, the array further comprising:

a second foldable panel foldably attached to the central panel and comprising an upper surface, a bottom surface opposite from the upper surface, and a third plurality of radiating elements disposed on the bottom surface;

a third foldable panel foldably attached to the central panel and comprising an upper surface, a bottom surface opposite from the upper surface, and a fourth plurality of radiating elements disposed on the bottom surface; and a fourth foldable panel foldably attached to the central panel and comprising an upper surface, a bottom surface opposite from the upper surface, and a fifth plurality of radiating elements disposed on the bottom surface;

each of the second foldable panel, the third foldable panel, and the fourth foldable panel being foldable such that it is capable of: folding onto the upper surface of the central panel and having the upper surface thereof face the upper surface of the central panel; and folding onto the bottom surface of the central panel and having the bottom surface thereof face the bottom surface of the central panel, the method further comprising:

folding the second foldable panel onto the upper surface of the central panel and having the upper surface of the second foldable panel face the upper surface of the central panel, thereby having the third plurality of radiating elements be visible from the point of view above the upper surface of the central panel;

folding the third foldable panel onto the bottom surface of the central panel and having the bottom surface of the third foldable panel face the bottom surface of the central panel; and folding the fourth foldable panel onto the bottom surface of the central panel and having the bottom surface of the fourth foldable panel face the bottom surface of the central panel.

15. The method according to claim 14, further comprising:

folding the first foldable panel onto the bottom surface of the central panel and having the bottom surface of the first foldable panel face the bottom surface of the central panel; and folding the second foldable panel onto the bottom surface of the central panel and having the bottom surface of the second foldable panel face the bottom surface of the central panel; and folding the third foldable panel and the fourth foldable panel onto the upper surface of the central panel and having the upper surface of the third foldable panel and the upper surface of the fourth foldable panel face the upper surface of the central panel, thereby having the fourth plurality of radiating elements and the fifth plurality of radiating elements be visible from the point of view above the upper surface of the central panel and changing the electromagnetic properties of the array.

16. The method according to claim 14, the array further comprising a plurality of hinges, each of the first foldable panel, the second foldable panel, the third foldable panel, and the fourth foldable panel being respectively attached to the central panel by a hinge of the plurality of hinges.

17. The method according to claim 16, the first foldable panel, the second foldable panel, the third foldable panel, the fourth foldable panel, the central panel, and the plurality of hinges being monolithically formed with each other.

18. The method according to claim 14, the upper surface of each of the first foldable panel, the second foldable panel, the third foldable panel, and the fourth foldable panel having an area that is about one half that of the upper surface of the central panel.

19. The method according to claim 12, the upper surface of the first foldable panel having an area that is less than that of the upper surface of the central panel.

20. A reflectarray, comprising:

a central panel comprising an upper surface, a bottom surface opposite from the upper surface, and a first plurality of radiating elements disposed on the upper surface;

a first foldable panel foldably attached to the central panel and comprising an upper surface, a bottom surface opposite from the upper surface, and a second plurality of radiating elements disposed on the bottom surface;

a second foldable panel foldably attached to the central panel and comprising an upper surface, a bottom surface opposite from the upper surface, and a third plurality of radiating elements disposed on the bottom surface;

a plurality of hinges, each of the first foldable panel and the second foldable panel being respectively attached to the central panel by a hinge of the plurality of hinges, the first foldable panel, the second foldable panel, the central panel, and the plurality of hinges being monolithically formed with each other, the first foldable panel being foldable such that it is capable of: folding onto the upper surface of the central panel and having the upper surface of the first foldable panel face the upper surface of the central panel; and folding onto the bottom surface of the central panel and having the bottom surface of the first foldable panel face the bottom surface of the central panel, the second foldable panel being foldable such that it is capable of: folding onto the upper surface of the central panel and having the upper surface of the second foldable panel face the upper surface of the central panel; and folding onto the bottom surface of the central panel and having the bottom surface of the second foldable panel face the bottom surface of the central panel, the upper surface of each of the first foldable panel and the second foldable panel having an area that is less than that of the upper surface of the central panel, the central panel comprising a substrate on which the first plurality of radiating elements disposed on the upper surface, the first foldable panel comprising a substrate on which the second plurality of radiating elements is disposed, the second foldable panel comprising a substrate on which the third plurality of radiating elements is disposed, a material of the substrate of the central panel being the same as that of the first foldable panel and that of the second foldable panel, and the second plurality of radiating elements and the third plurality of radiating elements being configured such that different patterns of radiating elements are formed by folding different combinations of the first foldable panel and the second foldable panel onto the upper surface of the central panel.

* * * * *